US007523580B1

(12) United States Patent
Tankersley

(10) Patent No.: US 7,523,580 B1
(45) Date of Patent: Apr. 28, 2009

(54) HANDGUARD SYSTEM INTEGRATED TO A FIREARM

(76) Inventor: Jerome Benedict Tankersley, 208 Braehead Dr., Fredericksburg, VA (US) 22401

( * ) Notice: Subject to any disclaimer, the term of this patent is extended or adjusted under 35 U.S.C. 154(b) by 172 days.

(21) Appl. No.: 11/593,439

(22) Filed: Nov. 6, 2006

Related U.S. Application Data

(60) Provisional application No. 60/734,193, filed on Nov. 7, 2005.

(51) Int. Cl.
*F41C 23/16* (2006.01)

(52) U.S. Cl. ..... 42/71.01

(58) Field of Classification Search ..... 42/71.01, 42/72, 73, 74, 85, 96, 188, 304.4, 313.3, 42/314.2, 321.5, 457, 911; 89/36.01, 36.02, 89/36.03, 36.04, 36.07, 36.08, 36.09, 36.12, 89/36.17

See application file for complete search history.

(56) References Cited

U.S. PATENT DOCUMENTS

| | | | | |
|---|---|---|---|---|
| 2,951,424 | A | 9/1960 | Stoner | |
| 3,075,314 | A * | 1/1963 | Bakker | 42/71.01 |
| 3,198,076 | A | 8/1965 | Stoner | |
| 5,198,600 | A | 3/1993 | E'Nama | |
| 5,412,895 | A | 5/1995 | Krieger | |
| 5,590,484 | A | 1/1997 | Mooney | |
| 5,826,363 | A | 10/1998 | Olson | |
| 6,044,748 | A | 4/2000 | Westrom | |
| 6,345,464 | B1 | 2/2002 | Kim | |
| 6,490,822 | B1 | 12/2002 | Swan | |
| 6,499,245 | B1 | 12/2002 | Swan | |
| 6,508,027 | B1 | 1/2003 | Kim | |
| 6,606,812 | B1 * | 8/2003 | Gwinn, Jr. | 42/75.02 |
| 6,671,990 | B1 | 1/2004 | Booth | |
| 6,694,660 | B1 | 2/2004 | Davies | |
| 6,895,708 | B2 * | 5/2005 | Kim et al. | 42/72 |
| 6,959,509 | B2 | 11/2005 | Vais | |

FOREIGN PATENT DOCUMENTS

WO WO2006/103062 10/2006

OTHER PUBLICATIONS

Stevens and Ezell, The Black Rifle, 1994, p. 336 Figs 357, 358 Collector Grade Publications, Inc. Coberg, Ontario, Canada.

(Continued)

*Primary Examiner*—Bret Hayes

(57) ABSTRACT

Existing floating handguards have the problem of adding size and weight to M16 style gas operated rifles because these tubular handguards attach to a relatively large diametral surface which lies outward of a firearm operating member or gas tube. Existing handguards are mounted thus so that the handguard inside surface will mechanically clear the gas tube. The present invention solves this problem by providing a handguard system integrated to a firearm, the system having a one-piece extended barrel nut with a smaller diameter outer surface configured to lie inward of the gas tube, between the gas tube and the barrel. A one-piece generally tubular handguard has an outer surface with a longitudinal rib and an inner surface with an inner diameter and a groove which is aligned with the rib. The handguard inner diameter engages the barrel nut outer surface and the groove provides clearance for the gas tube. The rib is configured to maintain the rigidity of the handguard adjacent the groove.

21 Claims, 11 Drawing Sheets

OTHER PUBLICATIONS

Stevens and Barrocci, Black Rifle II, Apr. 2004, pp. 77, 79, 114, Collector Grade Publications, Inc Coberg, Ontario, Canada.
Martin and Tillman, Complete Guide to Aris Accuracy, 2000, pp. 126-130, Precision Shooting Inc, Manchester, CT, USA.
Brownells Catalog No. 51, 1998-1999, p. 86 Brownells, 1998, Montezuma, Iowa, USA.
Brownells Catalog No. 58, 2005-2006, p. 23 Brownells, 2005, Montezuma, Iowa, USA.
U.S. Appl. No. 60/734,193, Not Publ., Jerome B. Tankersley, Entire Document.
U.S. Appl. No. 11/975,881, Not Publ., Jerome B. Tankersley, Entire Document.
U.S. Appl. No. 12/214,930, Not Publ., Jerome B. Tankersley, Entire Document.

* cited by examiner

Fig. 2A Enlarged Scale

Enlarged Scale

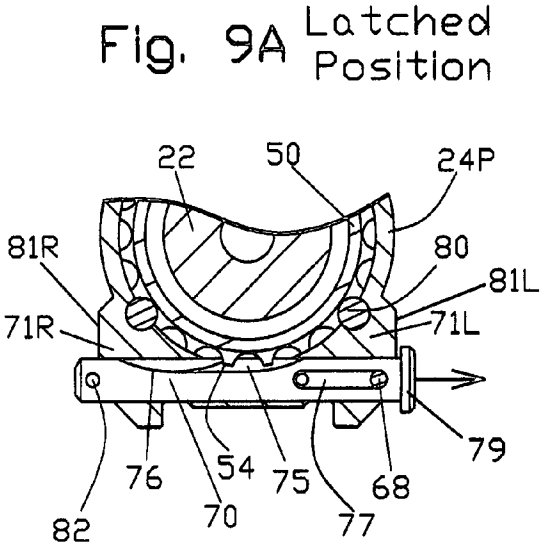
Fig. 9A Latched Position
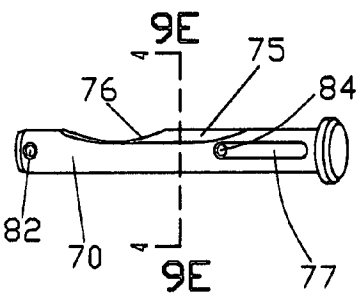
Fig. 9D
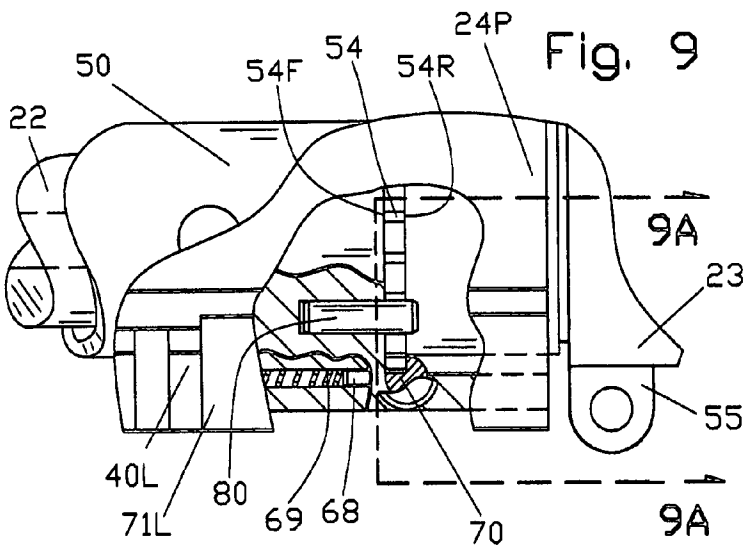
Fig. 9
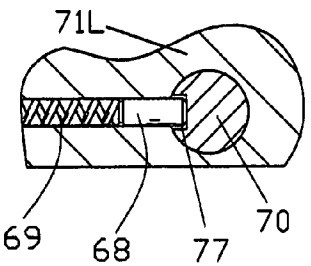
Fig. 9C Enlarged
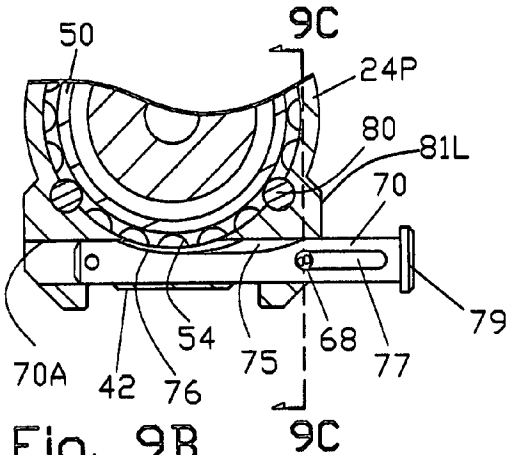
Fig. 9B Unlatched Position

HANDGUARD SYSTEM INTEGRATED TO A FIREARM

CROSS-REFERENCE TO RELATED APPLICATIONS

This application claims the benefit of Provisional Patent Application No. 60/734,193 filed Nov. 7, 2005.

FEDERALLY SPONSORED RESEARCH

None

SEQUENCE LISTING

None

FIELD OF THE INVENTION

This invention relates to integration means, and more particularly to means for interfacing accessories to a firearm.

BACKGROUND OF THE INVENTION

Prior Art

For many years firearms have employed handguards to protect the user's hands from a hot barrel and to provide a secure gripping means. The four service rifles adopted by the United States armed forces during the twentieth century, the M1903, the M1 Garand, the M14, and the M16 incorporated handguards which made contact with the barrel at multiple locations.

These conventional handguards, contacting the barrel in this manner, can transmit external forces to the barrel, sometimes reducing firearm accuracy.

Although these handguards function as intended, it has been well established in the field of competitive target shooting that rifles with barrels that are isolated or "float" without touching the two handguard ends provide superior shooting accuracy. Furthermore, handguards that do not touch the barrel at both ends of the handguard are less likely to conduct unwanted heat into the handguard.

The M16 rifle is a gas operated rifle adopted by the United States armed forces during the period 1962-63. Many variations have been produced since that time including civilian models for sporting uses such as target shooting competition.

The group of firearms generally considered "M16 style" includes gas operated rifles, carbines and pistols (essentially carbines without stocks) with common design features including a barrel which attaches with a barrel nut, and a gas tube and gas block which are part of the operating mechanism. More recently, pushrods have replaced gas tubes for some variations. The firearms have many designations including M16A2, AR15, M4 and the larger frame Armalite AR10 which includes a larger barrel, barrel nut, and other parts. Patents that bear on M16 development include U.S. Pat. Nos. 2,951,424 and 3,198,076 to Stoner, and U.S. Pat. No. 6,044,748 to Westrom.

Most M16 style firearms produced have conventional, "non-floating" handguards. More recently there has been an increasing trend to issue floating handguard designs to selected military and law enforcement units.

Handguards designed to float the barrel are marketed by several terms, including "float tubes", "floating handguards", and "free float sleeves". Prior art floating handguard systems for M16 style firearms which have the potential for improved accuracy compared to conventional handguards include U.S. Pat. No. 6,490,822 to Swan, which mounts to the firearm receiver, and other designs which mount to a floating handguard barrel nut which secures the barrel to the receiver. These designs do not attach at both ends of the handguard, unlike many conventional handguard designs.

Since the 1980's, development of firearm accessories related to optical, laser, and other rapid-growth technologies has resulted in an expansion of the handguard function to include serving as an interface for these devices.

More recently, secondary optics and gun sights, supplemental insulating handguards (handgrips), sling devices, and removable military standard rails have been proliferating and must be interfaced to the firearm, frequently being attached to a handguard rail by rail clamp devices integrated to the accessory. In addition, threaded holes and inserts in handguards allow accessory devices to be attached with screws.

In providing this additional functionality, handguards have evolved to being more generally considered as handguard systems.

Considering related prior art, three patents will be briefly summarized. U.S. Pat. No. 5,412,895 to Krieger describes a two-piece barrel nut involving multiple threaded portions instead of the original one-piece nut with a single internal threaded portion utilized by the M16 rifle. U.S. Pat. No. 6,671,990 to Booth discloses a combination barrel nut and spacer, the outer surface of the spacer located outward of the firearm gas tube, the inner surface of a handguard tube engaging the outer surface of the spacer.

U.S. Pat. No. 6,694,660 to Davies describes a single-piece barrel nut with an inner and an outer surface, and a plurality of longitudinal holes between the two surfaces to allow passage of an operating part or gas tube. The barrel nut outer surface is located outward of the operating part and the tubular handguard inner surface engages the barrel nut outer surface.

Prior handguard systems, although functional, have several important deficiencies:

(a) Prior floating handguards are often attached to a large diameter barrel nut outer surface which lies outward of the firearm gas tube, resulting in a handguard which adds to the size and weight of the firearm, and mounts the accessories far from the barrel centerline. This results in a heavier weapon with diminished handling qualities.

(b) Installing and removing the handguard to and from the firearm is usually a slow and laborious process, often involving removing multiple screws, and unscrewing a handguard tube from its threaded mounting. This difficulty eliminates the possibility of rapidly changing out a handguard, included its attached accessories, and installing another handguard with a different complement of accessories for a different mission, while the user retains the original familiar firearm.

(c) Some handguards contact the barrel at both ends of the handguard, potentially causing impaired shooting accuracy and increased handguard heating.

(d) Many prior handguards do not have integral military standard dovetail rails or threaded holes, thus limiting their ability to mount accessories.

It would be highly advantageous, therefore, to remedy these and other deficiencies embodied in the prior art. The advantages of this handguard system integrated to a firearm will become apparent after the consideration of the ensuing description and drawings.

SUMMARY

Provided is a handguard system integrated to an M16 style firearm. The firearm minimally has a barrel, a receiver, and an operating member or gas tube. The gas tube is offset from the barrel in order to align with and engage a gas tube port in the receiver.

The handguard system includes a one-piece extended barrel nut having a tubular shape, and an inner surface which is configured to engage the threads of the receiver and secure the barrel to the receiver. The barrel nut also has an outer surface with a relatively small outer diameter, the outer surface configured to lie inward of the gas tube, between the gas tube and the barrel.

The present invention further includes a one-piece handguard having a generally tubular shape and an inner and an outer surface. The outer surface includes a longitudinal rib. The handguard inner surface has an inner diameter and a groove, the groove being aligned with the rib on the outer surface.

Unlike some prior art handguard systems which employ a barrel nut with a threaded outer surface engaging the threaded inner surface of a tubular handguard, the present invention extended barrel nut outer surface is an unthreaded surface and the handguard inner surface is an unthreaded surface.

The handguard inner diameter is slightly larger than the barrel nut outside diameter. The handguard groove provides clearance to the gas tube and the rib is configured to maintain the rigidity of the handguard adjacent to the groove. The handguard inner surface is adapted to allow the handguard to install over the barrel muzzle, slide along and over the barrel, gas tube and barrel nut, with the handguard inner diameter engaging the barrel nut outer diameter.

The smaller diameter barrel nut allows for a smaller, more compact handguard tube with substantial weight and size savings when compared to prior art. The firearm barrel is free floating since the handguard tube only attaches at the handguard rearward end, and does not touch the barrel forward. The handguard is able to quickly attach to a firearm utilizing a transverse pin.

DRAWINGS

Figures

FIG. 2A is an enlarged scale, partial perspective view of the extended barrel nut of the present invention showing prong detail.

FIG. 9 is a partial side elevational view of the present invention showing an alternate embodiment handguard with latch pin instead of a latch plate mounted to a conventional receiver.

FIG. 9A is a front cross-sectional view showing the latch pin in the latched position.

FIG. 9B is a front cross-sectional view showing the latch pin in the unlatched position.

FIG. 9C is a partial sectional view showing the engagement of the detent with the latch pin slot, shown at an enlarged scale.

FIG. 9D is a perspective view of the latch pin showing the latching surface, relief cut detent slot and assembly hole.

DRAWINGS

Reference Characters

Like parts have like reference characters

Figure 1:
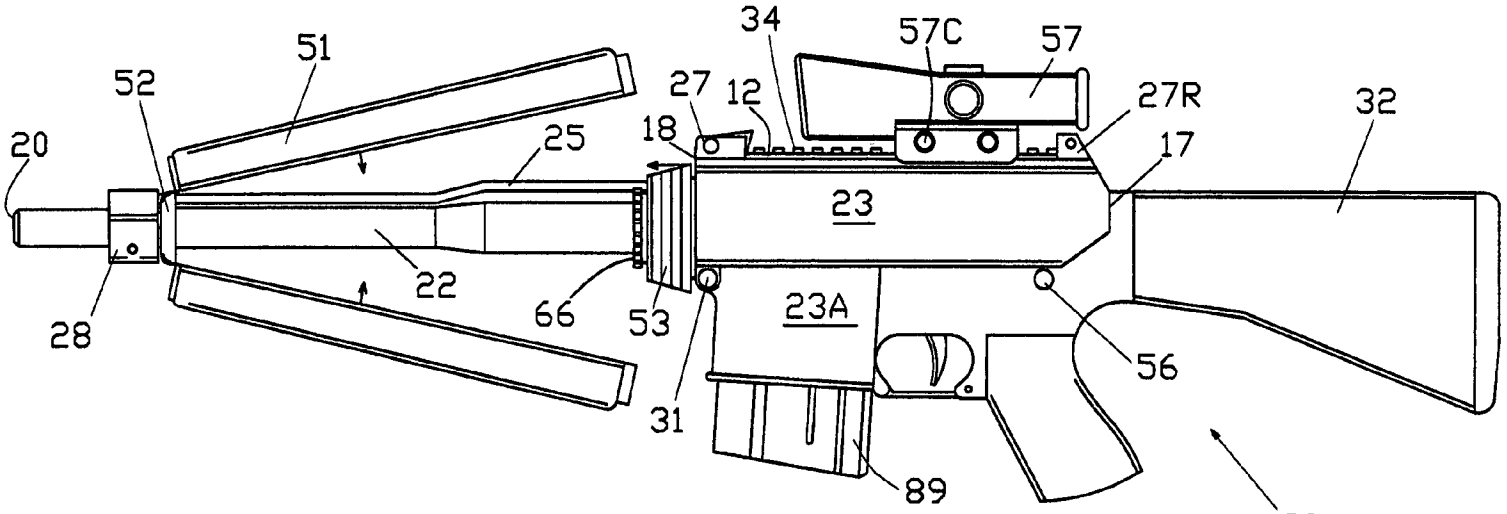
Fig. 1 Prior Art
FIG. 1 is a side elevational view of a prior art conventional M16 style firearm with typical rail mounted accessories installed and conventional handguards partially removed.

12—receiver top rail
13—handguard bottom
14—handguard top
15—handguard rear end
16—handguard front end
17—receiver rear end
18—receiver forward end
19—handguard groove
20—muzzle
21—handguard system
22—barrel
23—upper receiver
23S—upper receiver with slot in forward lug

23A—lower receiver
24—handguard
24B—basic handguard embodiment, 24N—inner surface, 24X—outer surface
24C—basic handguard for alternate barrel nut
24P—alternate embodiment handguard with latch pin
24Y—alternate handguard inner surface
24Z—alternate handguard outer surface
25—gas tube
26—receiver gas tube port
27—secondary front sight
27R—secondary rear sight
28—gas block
29L—handguards left side
29R—handguard right side
30—M16 style firearm
31—forward transverse pin
31A—receiver pin hole
32—stock
33—receiver lug slot
34—receiver flat top
35—latch plate
35A—latch plate transverse hole
35R—latch plate recess
36—latch plate screw
36T—threaded hole for latch plate screw
37—handguard inner diameter
38—second inner diameter
39—handguard shoulder
40L—lower left integral rail
40R—lower right integral rail
41L—left side helicoil insert
41R—right side helicoil insert
42—bottom rib
43—bottom integral rail
44—removable rail
44A—screw for removable rail
45—upper integral rail
46L—upper left helicoil insert
46R—upper right helicoil insert
47L—upper left vent holes
47R—upper right vent holes
48—top rib
49—top rail
50—extended barrel nut
50D—nut outer diameter
51—prior art handguard
52—forward end cap
53—D ring end cap
54—prongs
54F—prong forward face
54R—prong rear face
55—forward lug
56—rear transverse pin
57—optical gun sight
57C—optical gun sight rail clamp device
58—barrel nut internal thread
59—annular shoulder
59D—shoulder inner diameter
60—nut vent through-hole
61—barrel extension
62—flange
63—barrel port face
64—barrel port
66—conventional barrel nut
67—prior art barrel nut for floating handguard
67H—barrel nut holes 4
67N—prior art nut inner surface
67X—prior art nut outer surface
68—detent
68A—detent hole
69—detent spring
70—latch pin
70A—latch pin hole
71L—handguard base left
71R—handguard base right
72—adjustment screw
73—handgrip screw
74—bottom vent holes
75—latch surface
76—relief cut
77—detent slot
78—handgrip
78A—handgrip vent hole
79 latch pin head
80—alignment pins
81L—left base face
81R—right base face
82—wire hole
84—disassembly hole
85—bottom helicoil insert
87—prior art floating tubular handguard
87N—prior art handguard inner surface
87X—prior art handguard outer surface
88—barrel nut inner surface
89—magazine
90—alternate extended barrel nut with grooves
90D—alternate nut outer diameter
90G—alternate nut grooves
90N—alternate nut inner surface
98—outwardmost portion of gas tube

DETAILED DESCRIPTION OF THE INVENTION

For the purposes of this application, the term "M16 style" firearm refers to gas operated rifles, carbines, and pistols (carbines without stocks) with common design features and various designations including M16A2, AR15, M4 and AR10. However it is to be understood that other similar firearms could benefit from this invention.

Referring now to the drawing figures where like reference characters indicate like parts throughout the various figures, FIG. 1 shows a conventional M16 style firearm generally designated 30. A barrel 22 having a front end or muzzle 20 is joined to a conventional upper receiver 23 and secured with a conventional barrel nut 66.

A low profile gas block 28 is attached to barrel 22 and a gas tube 25 connects low profile gas block 28 to receiver 23. Gas block 28 serves to direct gas from barrel 22 into gas tube 25 in order to operate a mechanism, not shown, within receiver 23. Gas blocks have several styles which will be described presently.

A lower receiver 23A is coupled to upper receiver 23 by a rear transverse pin 56 and a forward pivot pin or transverse pin 31. Lower receiver 23A holds a magazine 89 in its lower portion and has a stock 32 attached to its rear portion. Pins 31 and 56 are retained in lower receiver 23A by spring and detent devices, not shown.

Upper receiver 23 has a forward end 18, a rear end 17, and a top 34. Receiver top 34 is shown configured with a military standard rail 12 which is defined as having a dovetail cross section about 0.83 inch wide, and a flat outer surface with a plurality of transverse slots. This rail configuration is also known as a MIL-STD-1913 rail. Mounted to rail 12 are conventional rail mounted accessory devices including a secondary front sight 27, a secondary rear sight 27R, and an optical sight 57 which includes a rail clamp device 57C for attaching sight 57 to rail 12.

Still referring to FIG. 1, a pair of conventional handguards 51 are shown partially removed from firearm 30. When installed, the forward portions of handguards 51 are positioned and retained within a forward cap 52 which is in contact with barrel 22, and the rear portions rest against barrel nut 66 and are captured by a spring-loaded, forward biased D ring cap 53.

In FIG. 1, cap 53 is shown moved rearward to expose nut 66. External forces on handguards 51 are transmitted to forward cap 52, nut 66 and to barrel 22, possibly affecting firearm accuracy.

Figure 1B:
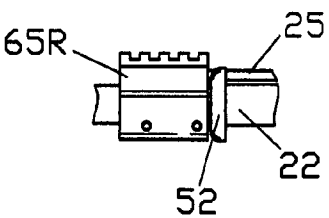
Fig. 1B Prior Art
FIG. 1B is a side elevational view of a prior art conventional integral rail gas block mounted to a barrel.
Figure 1A:
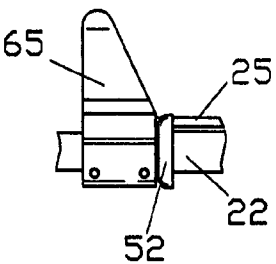
Fig. 1A Prior Art
FIG. 1A is a side elevational view of a prior art conventional integral sight gas block mounted to a barrel.

Now referring to FIGS. 1, 1A, 1B, two other types of gas block for M16 style firearms are depicted. FIG. 1A shows an integral sight gas block 65 which is often applied when optical sights are not used. Compared to low profile block 28 which has an overall height of about 1.4 inch, integral sight gas block 65 is much larger with a height of about 3.6 inch. FIG. 1B shows an integral rail gas block 65R which has a height of about 1.7 inch.

The handguard system of the present invention can be employed to substantial advantage, including handguard size and weight reductions, on a firearm fitted with any of the conventional gas blocks described above. In the interest of minimum firearm size, weight, and overall utility, low profile gas block 28 is presently a recommended part of the firearm environment.

Figure 1D:
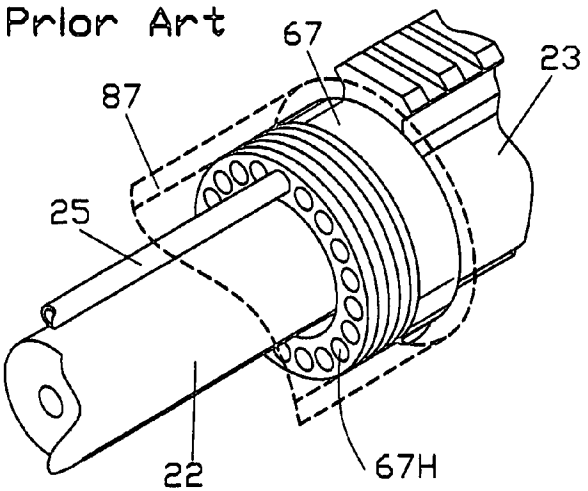
Fig. 1D Prior Art
FIG. 1D is a front perspective view of a prior art floating handguard and barrel nut and barrel installed on a conventional receiver.
Figure 1C:
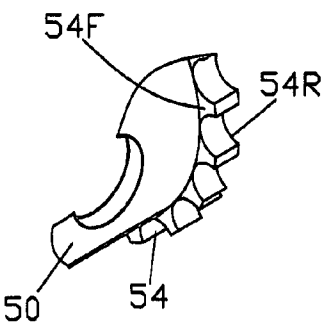
Fig. 1C Prior Art
FIG. 1C is a front perspective view of a prior art conventional barrel nut and barrel installed on a conventional receiver.
Figure 1C:
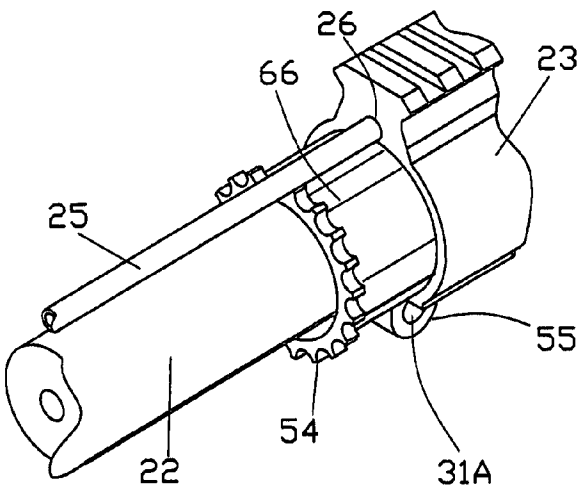
Fig. 1C Prior Art

Now referring to FIG. 1C shown is a more detailed perspective view of prior art conventional barrel nut 66 engaging receiver 23 and securing barrel 22 to receiver 23. The forward end of nut 66 has a plurality of prongs 54. Prongs 54 are configured to engage a wrench, not shown, and also to provide clearance to gas tube 25. Receiver 23 has a front lug 55 with a lug hole 31A for receiving forward pin 31 shown in FIG. 1.

Referring now to FIG. 1D, shown is a front perspective view of a typical prior art floating handguard barrel nut 67 engaging receiver 23 and securing barrel 22. This style barrel nut generally has an inner surface which engages receiver 23 and an outer surface lying outward of gas tube 25. The inner surface of a prior art floating handguard tube 87 engages the outer surface of nut 67.

A plurality of longitudinal holes 67H located between the inner and outer surfaces of nut 67 allow gas tube 25 to pass through. Barrel nuts 67 are produced with outer surfaces which are either fully threaded, or unthreaded, or a combination of both as shown in FIG. 1D. U.S. Pat. No. 6,694,660 to Davies describes an unthreaded outer surface.

Barrel nuts of this style with the nut outer surface outward of the gas tube require a handguard tube with an inner diameter of at least about 1.80 inch to engage the nut outer surface.

Figure 3:
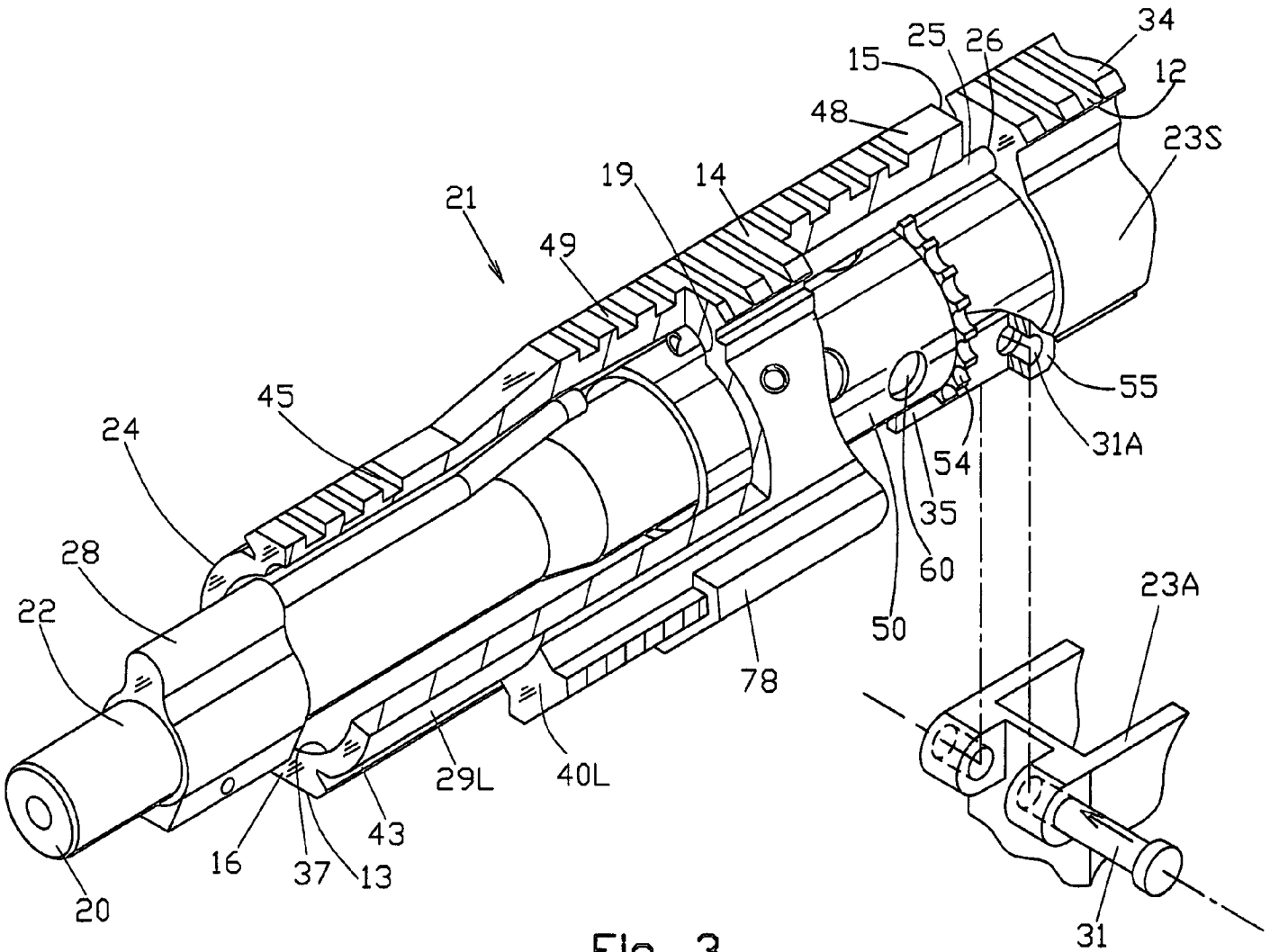
FIG. 3 is a front perspective partially exploded view with partial sections showing the handguard system installed on a receiver having a slotted forward lug and including a conventional barrel, gas tube and gas block.

Now referring to FIG. 3, depicted is a front perspective view showing a first embodiment handguard system of the present invention, generally designated as 21. FIG. 3 includes partial sections in order to reveal internal parts. Handguard system 21 is shown attached to a prior art M16 style firearm which includes conventional barrel 22, upper receiver 23S, gas tube 25, and low profile gas block 28.

Gas block 28 is attached to barrel 22, barrel 22 is joined to receiver 23S, and gas tube 25 connects gas block 28 to receiver 23S. Gas tube 25 is further defined as being disposed offset from barrel 22 in order to align with a receiver gas tube port 26.

A one-piece extended barrel nut 50 is the foundation member of handguard system 21. A handguard 24, the second principal member, will be described presently.

Since extended barrel nut 50 is the system foundation member, it will be the first part to be described in detail. In general terms, extended barrel nut 50 serves a double function in that it serves to secure barrel 22 to receiver 23S and also provides a simple, solid, and reliable structural support for handguard 24.

Receiver 23S is a conventional receiver 23 to which a slot 33 has been cut into lug 55. The purpose of slot 33 will be explained presently when discussing a specific embodiment in more detail.

As a rigid mounting structure, extended barrel nut 50 is longer than many prior art barrel nuts and has a length to outer diameter ratio in the range of 1.2:1 to 4:1 compared to many prior art barrel nuts with a length to outer diameter ratio of about 0.7:1.

Referring to FIGS. 2, 5, 6-6E, extended barrel nut 50 is a single integral piece having an elongated tubular shape, with an inner surface 88 having a threaded portion 58 adapted to threadably engage receiver 23S, and an outer surface with an outer diameter 50D, outer diameter 50D disposed to pass between barrel 22 and gas tube 25. The outer surface of barrel nut 50 also includes a plurality of nut vent through-holes 60. The quantity, size and location of vent holes 60 are configured to ensure a ventilation path for heat from barrel 22, vent holes 60 aligned with other system vent holes to be described presently.

Figure 5:
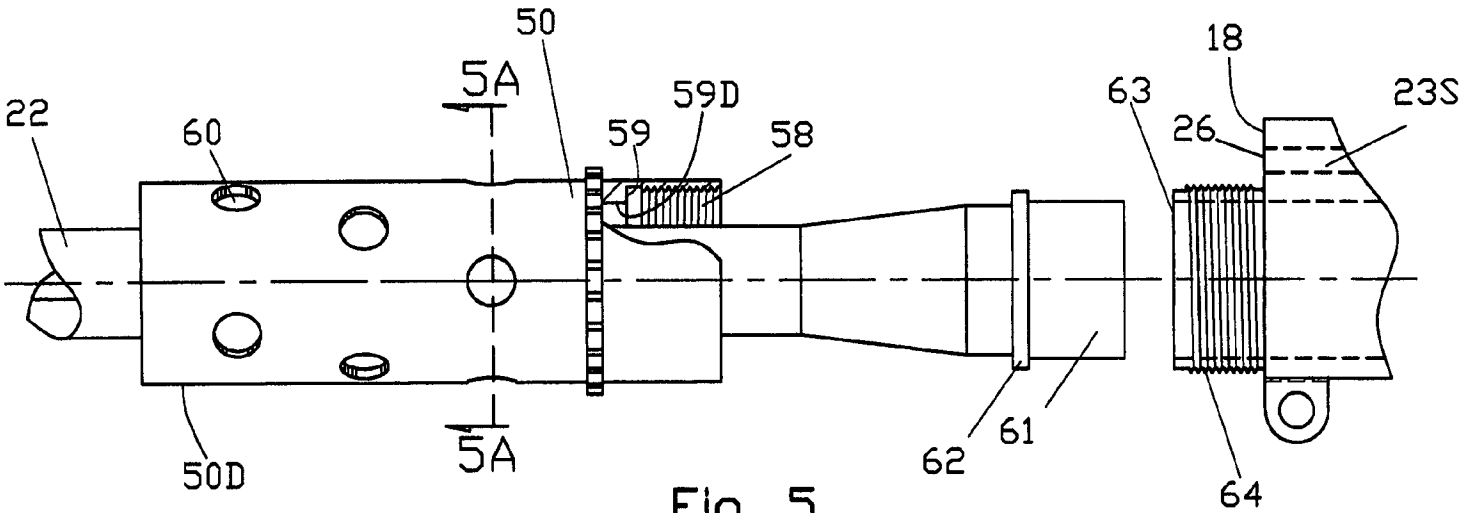
FIG. 5 is an exploded elevational view showing the extended barrel nut, barrel, and receiver with slotted forward lug.
Figure 5A:
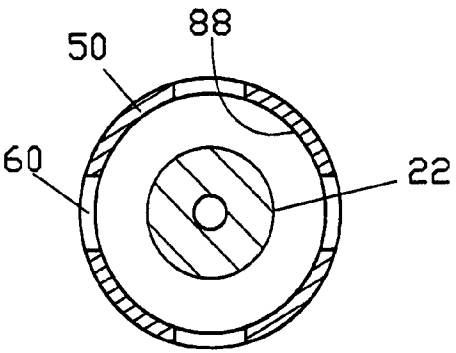
FIG. 5A is a sectional view of the extended barrel nut showing a vent hole pattern.

In FIG. 5, more detail of securing barrel 22 is provided. Barrel 22 also includes a rearward receiver end 61 with a flange 62. Receiver 23S also includes a hollow male threaded barrel port 64 having a port face 63. Barrel nut inner surface 88 also includes a shoulder 59 for urging barrel flange 62 against receiver port face 63. Shoulder 59 defines a shoulder inner diameter 59D which is smaller than threads 58 diameter.

For barrel installation, port 64 receives barrel end 61, extended barrel nut 50 is placed over barrel muzzle 20 and is moved along the barrel until its threads engage and are tightened against barrel port 64 threads, and shoulder 59 urges flange 62 against receiver barrel port face 63.

Figure 2:
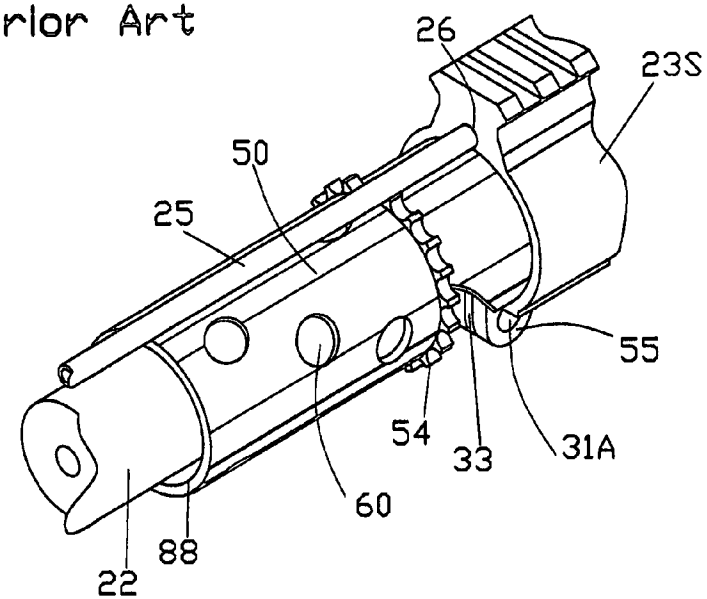
FIG. 2 is a front perspective view of the extended barrel nut of the present invention and a conventional barrel installed on a receiver having a slotted forward lug.

Referring to FIGS. 2, 2A, and 5, extended barrel nut 50 outer surface also has an array of radially protruding prongs 54, the prongs 54 having a forward face 54F, a rear face 54R, and a uniform space between adjacent prongs, the prongs 54 further defined as disposed on the outer surface slightly forward of the internally threaded portion 58, with prong 54 outer ends defining a prongs diameter.

Figure 6:
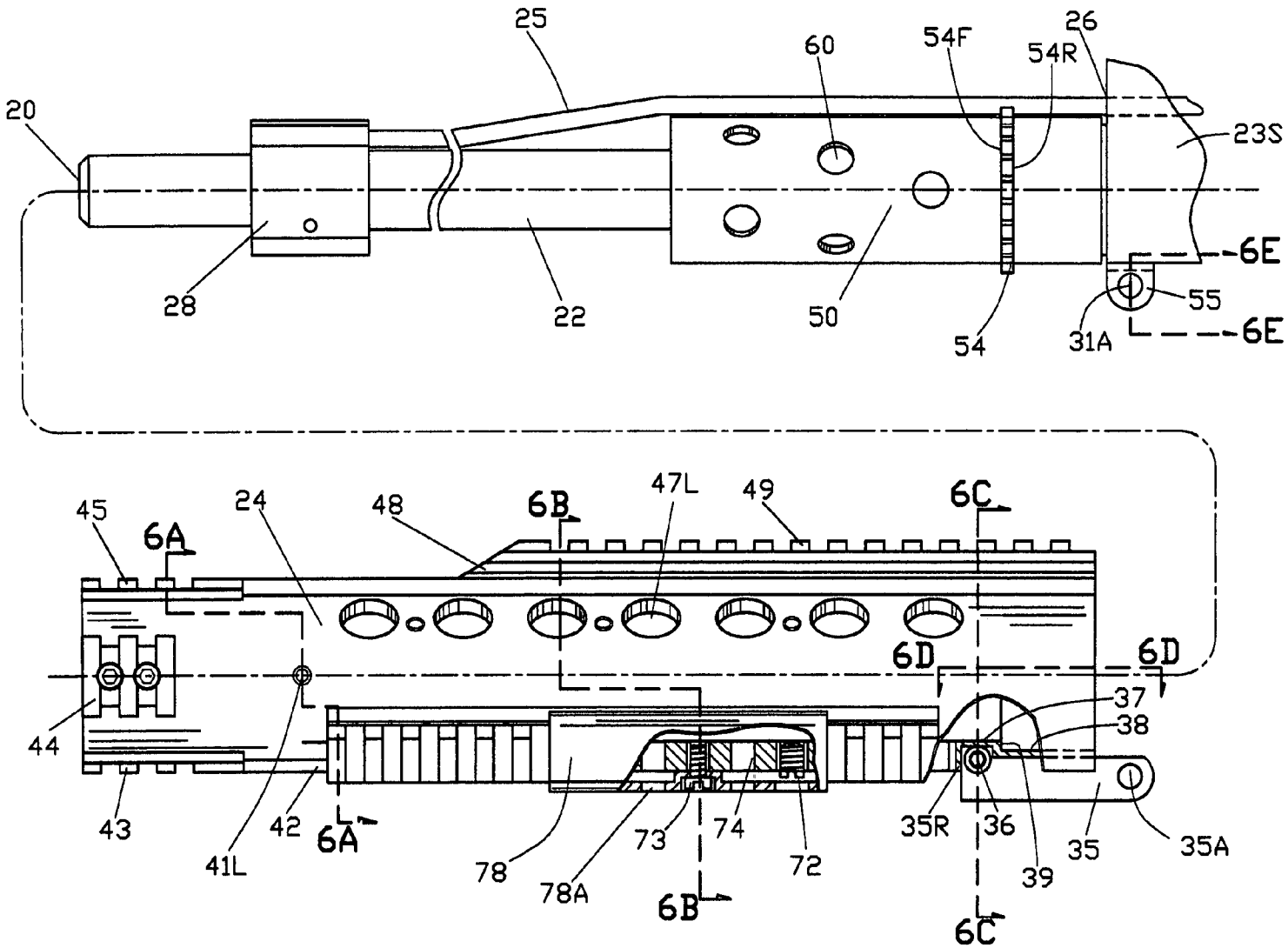
FIG. 6 is an exploded elevational view of the handguard system with partial sections.
Figure 6C:
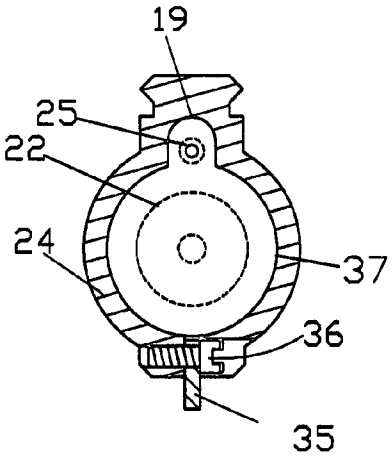
FIG. 6C is a cross-sectional front view of the handguard showing latch plate and latch plate screw.
Figure 6B:
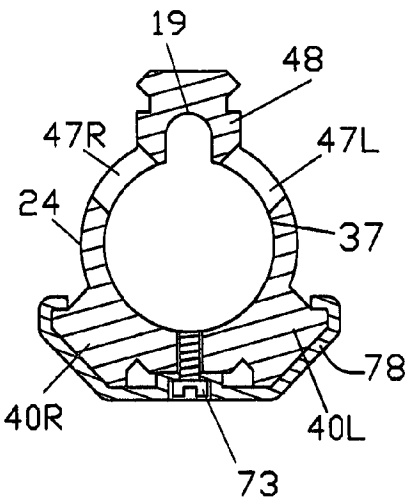
FIG. 6B is a cross-sectional front view of the handguard showing the handgrip and upper vent holes.
Figure 6A:
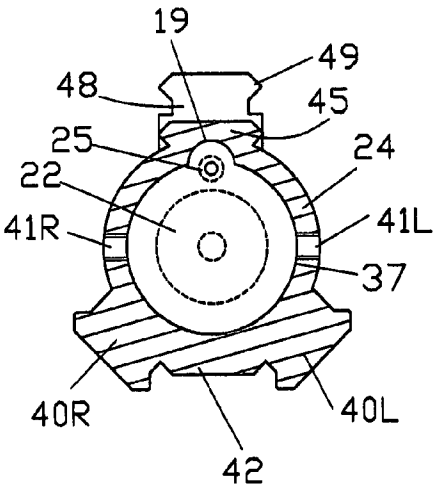
FIG. 6A is a cross-sectional front view of the handguard showing the lower integral rails and side helicoil inserts.

Now referring to FIGS. 3 and 6, handguard 24 is a single piece having a generally tubular shape with a front end 16, a rear end 15, a top 14, a bottom 13, a left side 29L and a right side 29R, an outer surface having a longitudinal top rib 48, and an inner surface having a first inner diameter 37, first inner diameter 37 being slightly larger than nut outer diameter 50D. Handguard 24 inner surface is further defined as having a groove 19 which is aligned with rib 48. Groove 19 is adapted to provide clearance to gas block 28 and gas tube 25 and rib 48 is configured to maintain handguard rigidity adjacent the groove.

First inner diameter 37 and groove 19 enable handguard 24 to slide over and along barrel 22, gas block 28, gas tube 25, and barrel nut 50. Handguard first inner diameter 37 engages nut outer diameter 50D. FIG. 6 shows a hand guard second inner diameter 38 that is adapted to provide clearance to prongs 54, creating a handguard shoulder 39.

Top rib 48 is depicted as running the full length of handguard 24, and having a greater height rearward, then sloping down at about handguard mid-length, to a lower level at handguard front 16. In this first embodiment, rib 48 is following the approximate contour of the path of gas tube 25, and groove 19, which is shaped to provide clearance to tube 25. The height of rib 48 varies at predetermined longitudinal locations in this case.

In a slightly different handguard embodiment, which could be an extruded aluminum shape, rib 48 and groove 19 could have a constant height at the maximum height needed to clear gas tube 25, handguard 25 then having a constant cross-section over its length.

With the two principal members of the present invention now described in some detail, it is appropriate at this time to compare these parts to the corresponding parts of a typical prior art floating handguard system in order to highlight the structural differences.

Figure 2C:
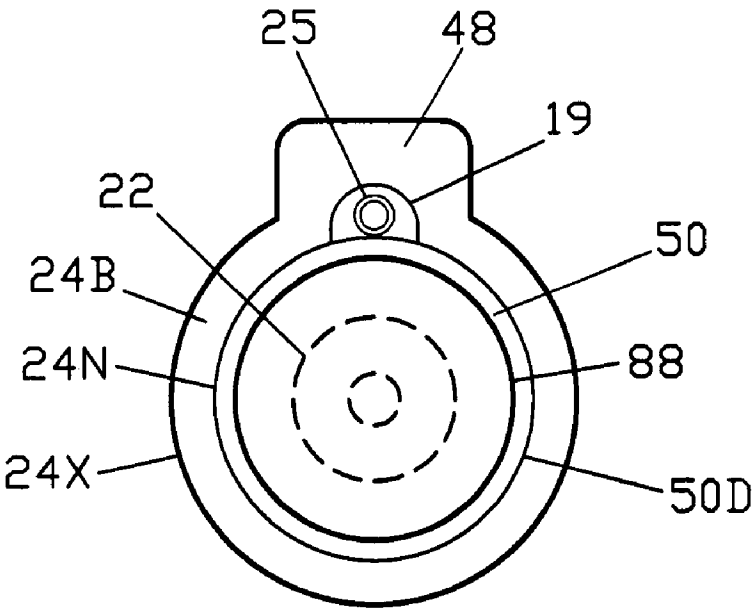
FIG. 2C is a diagrammic front view of the handguard system of the present invention showing the handguard engaging the extended barrel nut outer surface.
Figure 2B:
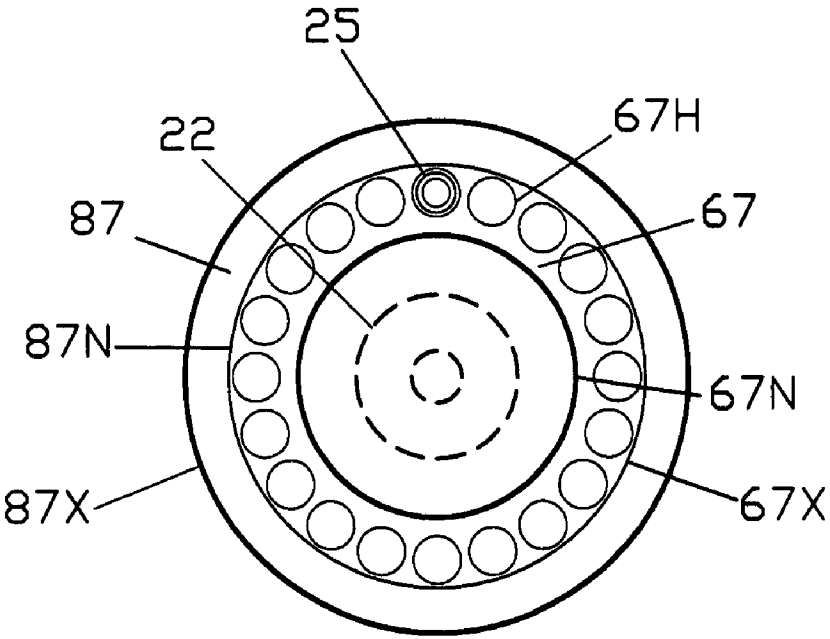
Fig. 2B Prior Art
FIG. 2B is a diagrammic front view of a prior art floating handguard system showing the tubular handguard engaging the barrel nut outer surface.

FIG. 2B is a diagrammic front view showing typical prior art floating handguard barrel nut 67 encircling barrel 22. This part was previously shown in FIG. 1D. Gas tube 25 is shown in its conventional location, offset from barrel 22. Barrel nut 67 has an inner surface 67N, and an outer surface 67X.

A plurality of holes 67H are in a radial array between inner surface 67N and outer surface 67X to ensure that a hole will align and provide clearance for tube 25 when nut 67 is tightened to a receiver, not shown. Engaging nut outer surface 67X is a prior art tubular handguard 87.

Handguard 87 has an inner surface 87N, and an outer surface 87X. Barrel nut outer surface 67X must lie outward of gas tube 25 in order to provide space for the array of tube clearance holes 67H. Most barrel nuts in the style of prior barrel nut 67 have an outer diameter of at least about 1.80 inch. For a tubular handguard wall thickness of 0.125 inch, accessories will be mounting to a handguard with at least a 2.05 inches outer diameter.

FIG. 2C is a diagrammic front view showing system barrel nut 50 of the present invention encircling barrel 22. Gas tube 25 is shown in its conventional location, offset from barrel 22. Shown are nut 50 inner surface 88, and an outer surface with diameter 50D. Note that nut outer diameter 50D lies inward of gas tube 25, between tube 25 and barrel 22. Nut inner surface 88 is adapted to secure barrel 22 to a receiver, not shown.

A basic or simplified tubular handguard 24B is shown engaging nut outside diameter 50D. Handguard 24B has an outer surface with longitudinal rib 48 and an inner surface including an inner diameter 24N, and groove 19. Groove 19 is aligned with rib 48 and adapted to provide clearance to gas tube 25.

Rib 48 is configured to maintain the rigidity of handguard 24 adjacent groove 19. In the present invention, extended barrel nut outer diameter 50D, lying inward of gas tube 25 is much smaller than prior art; nut 50D having for example, a nominal 1.375 inch dimension.

Thus, if handguard 24B also has a 0.125 inch wall thickness, accessories will be mounting to a 1.625 inch handguard diameter. Taking the diameter ratio in order to compare prior art to the present invention, 2.050/1.625=1.26. This equates to prior art handguards of this style mounting accessories 26 percent farther from the barrel centerline. In terms of handguard weight, the prior art carries additional weight per foot of tubing of about 18-20% compared to the present invention. This is after allowing for rib weight in the present invention. Tube exterior volume, which affects firearm size and handling is also greater for prior art handguards, being a function of the square of the outside diameters.

Figure 4:
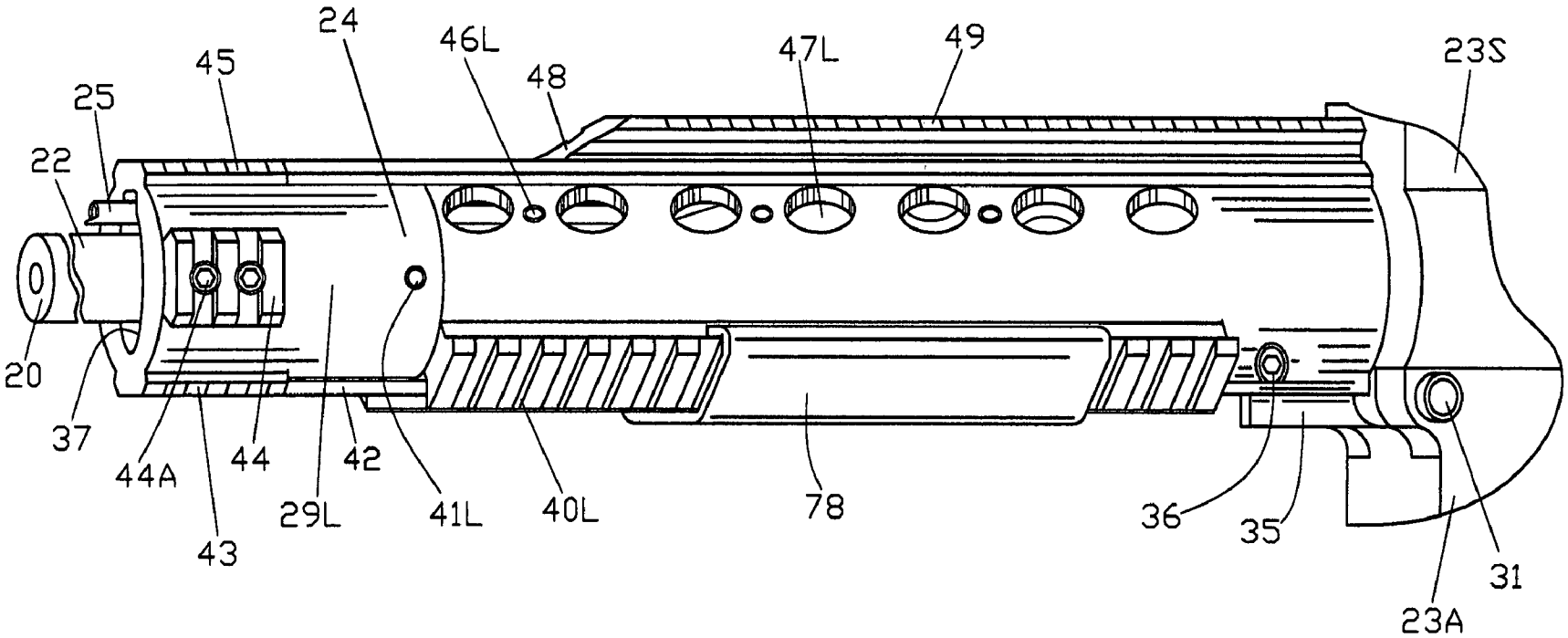
FIG. 4 is a perspective external view of the handguard installed on a receiver having a slotted forward lug and including a conventional barrel and gas tube.

Turning now to a more detailed description of handguard 24 of a first embodiment, and referring to FIGS. 3 and 4, a bottom rib 42 is formed on the handguard outer surface opposite top rib 48. Top rib 48 and bottom rib 42 are further defined as beginning at handguard rear end 15 and proceeding forward, each a separate predetermined distance, the ribs further defined as having a generally rectangular cross section and an outward flat surface, the flat surface having at least about the width of a standard military rail, the rail being about 0.83 inch wide.

Continuing to view FIGS. 3 and 4, portions of top rib 48 and bottom rib 42 are formed into military standard rails, a top rail 49, a front upper rail 45, and a bottom rail 43. The rails 49, 45, and 43 include a standard military dovetail cross section, which is about 0.83 inch wide, with a standard pattern of transverse slots on the flat outer face. This allows rails 49, 45 and 43 to mount accessory devices such as optics or lasers which have integral female rail mount devices.

Figure 8:
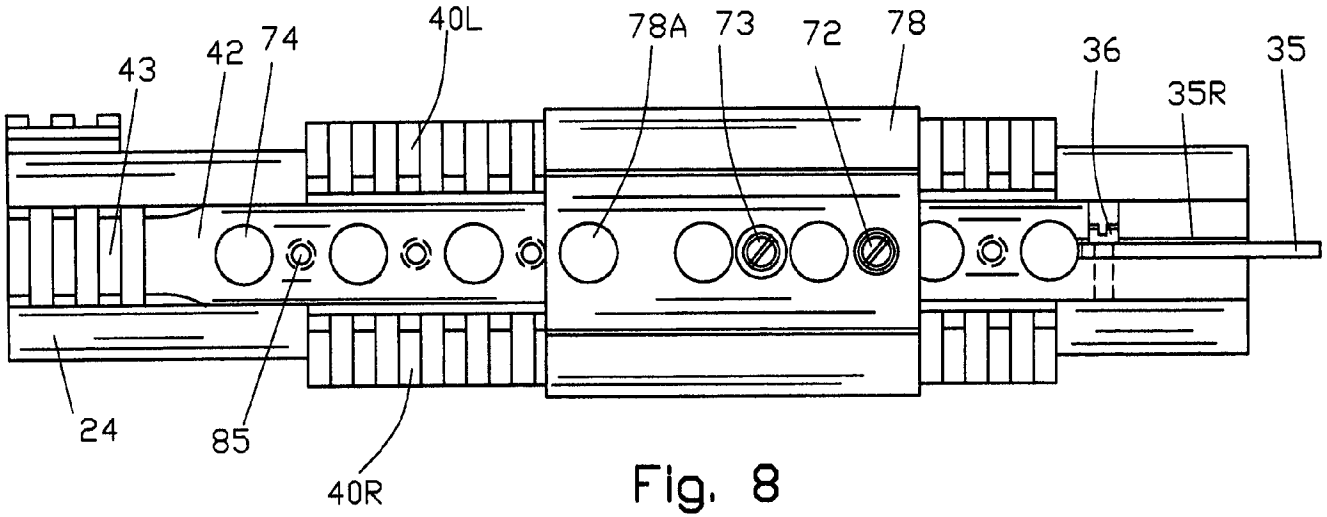
FIG. 8 is a bottom plan view of the handguard.

Referring now to FIGS. 3 and 8 shown are a lower left integral rail 40L and a lower right integral rail 40R. These integral military standard rails are positioned at about 45 degrees to a vertical longitudinal plane in order to provide a gripping surface or mount accessories such as lights or lasers.

A supplemental molded rail cover accessory or handgrip 78 is also shown engaging rails 40L and 40R, and additionally being attached with screw 73. A handgrip vent hole 78A prevents blocking of adjacent bottom vent holes 74. Rail covers are available in standard and custom configurations, such as handgrip 78. Obtaining a custom molded part usually requires a tooling or mold fee in addition to the part cost.

Referring to FIG. 6 and FIG. 8, a plurality of threaded helicoil inserts 85 and a plurality of vent through-holes 74 are distributed longitudinally along bottom rib 42 outer face, the inserts adapted to receive a screw. An adjustment screw 72 is threaded into helicoil insert 85, adjustment screw 72 disposed to bear upon barrel nut outer surface 50D, for influencing handguard 24 engagement with barrel nut 50, the engagement between the handguard 24 and the barrel nut 50 adjustable between a tight sliding fit and a fixed, immovable fit.

Figure 7:
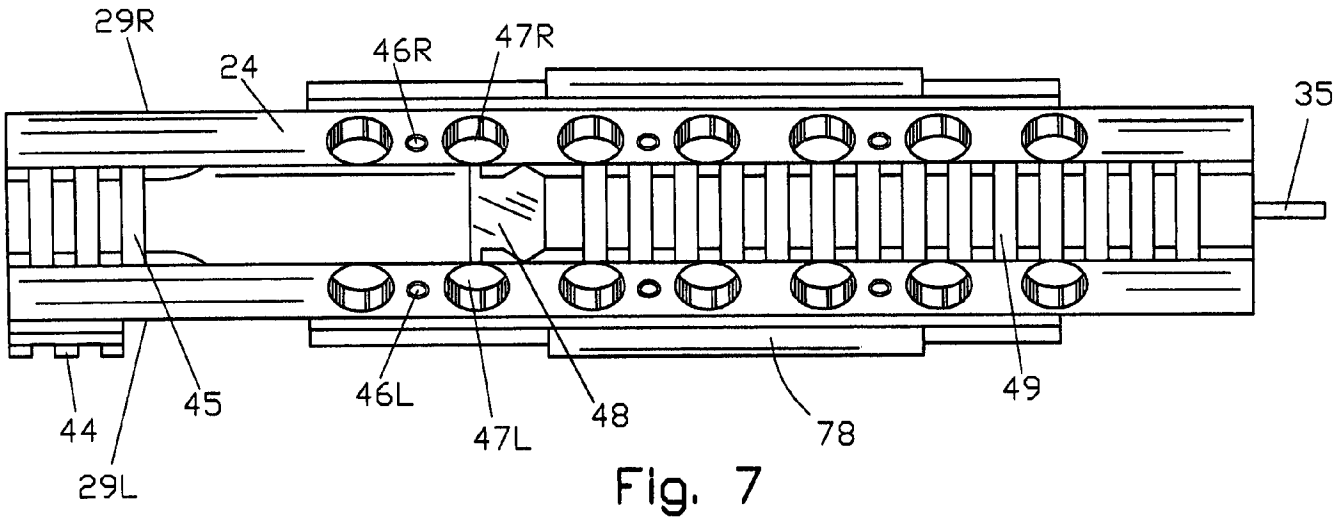
FIG. 7 is a top plan view of the handguard.

Now referring to FIGS. 4 and 7, handguard 24 has a plurality of longitudinally distributed vent through-holes 46L, 46R, and helicoil inserts 41L, 41R in handguard upper left and upper right portions; and a plurality of threaded helicoil inserts 41L,41R in the handguard forward left 29L and right sides 29R, the inserts permitting the mounting of an accessory device to the handguard by means of one or more screws.

Now referring to FIG. 4, a conventional removable military standard rail accessory 44 is attached to forward left side 29L of handguard 24, removable rail 44 attached with at least one screw 44A engaging a helicoil insert 41L, removable rail 44 allowing the interfacing of ancillary equipment.

Referring now to FIGS. 3 and 6, shown is a latchplate 35 which is a flat, steel member about 0.08 to 0.12 inch thick, 2 inches in length and 0.5 inch wide. Plate 35 forward portion is adapted to attach to handguard 24 lower rear portion by a screw 36. Plate 35 lies in a vertical plane and projects outward from the rear of handguard 24. Plate 35 further has a plate transverse hole 35A at its rear end and plate transverse hole 35A is adapted to receive a firearm transverse pin 31.

Now referring to FIGS. 2, 3, 6, and 6D, firearm receiver 23S has an integral forward lug 55 having a transverse hole 31A and a slot 33. Slot 33 is adapted to receive latch plate 35, lies in a vertical plane, runs longitudinally, and bisects forward lug 55.

Figure 6E:
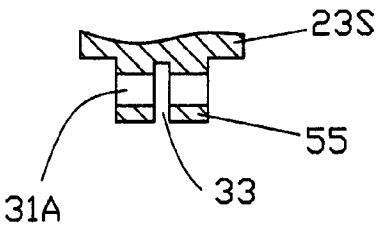
FIG. 6E is a partial front sectional view of a receiver with a slot added to accommodate the latch plate.
Figure 6D:
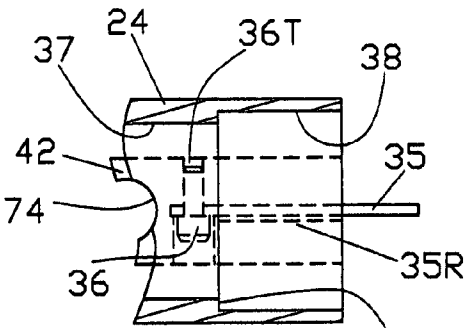
FIG. 6D is a sectional top plan view of the rear portion of the handguard showing the latch plate, latch plate recess, and latch plate screw.

Continuing to consider this first embodiment of the handguard system, and referring particularly to FIGS. 6 and 6D, handguard 24 has a recess 35R on its lower rear portion. Recess 35R is aligned with slot 33 in firearm receiver forward lug 55 and adapted to receive the upper portion of latch plate 35. Recess 35R also has a threaded hole 35T for receipt of screw 36 for fixing plate 35 to handguard 24.

To summarize the parts relationship of this first embodiment installed to a firearm, and referring to FIGS. 3, 6 and 6D, handguard 24 inner surface is adapted to slide over muzzle 20 of barrel 22, low profile gas block 28, gas tube 25, and system extended barrel nut 50.

Handguard first inner diameter 37 engages barrel nut outer diameter 50D, and latch plate 35 engages aligned receiver lug slot 33. When handguard 24 is fully installed onto barrel nut 50, handguard shoulder 39 abuts prongs forward face 54F and latch plate transverse hole 35A is aligned with lug transverse hole 31A. The aligned holes permit passage of firearm transverse pin 31, thereby securing handguard 24 to firearm receiver 23S. Latch plate 35, engaged with firearm transverse pin 31, limits rotational and longitudinal movement of handguard 24.

ALTERNATE EMBODIMENT

Handguard System

Figure 9E:
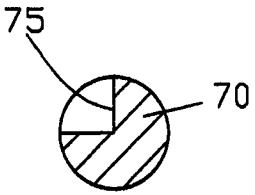
FIG. 9E is an enlarged cross-sectional view of the latch pin.
Figure 10:
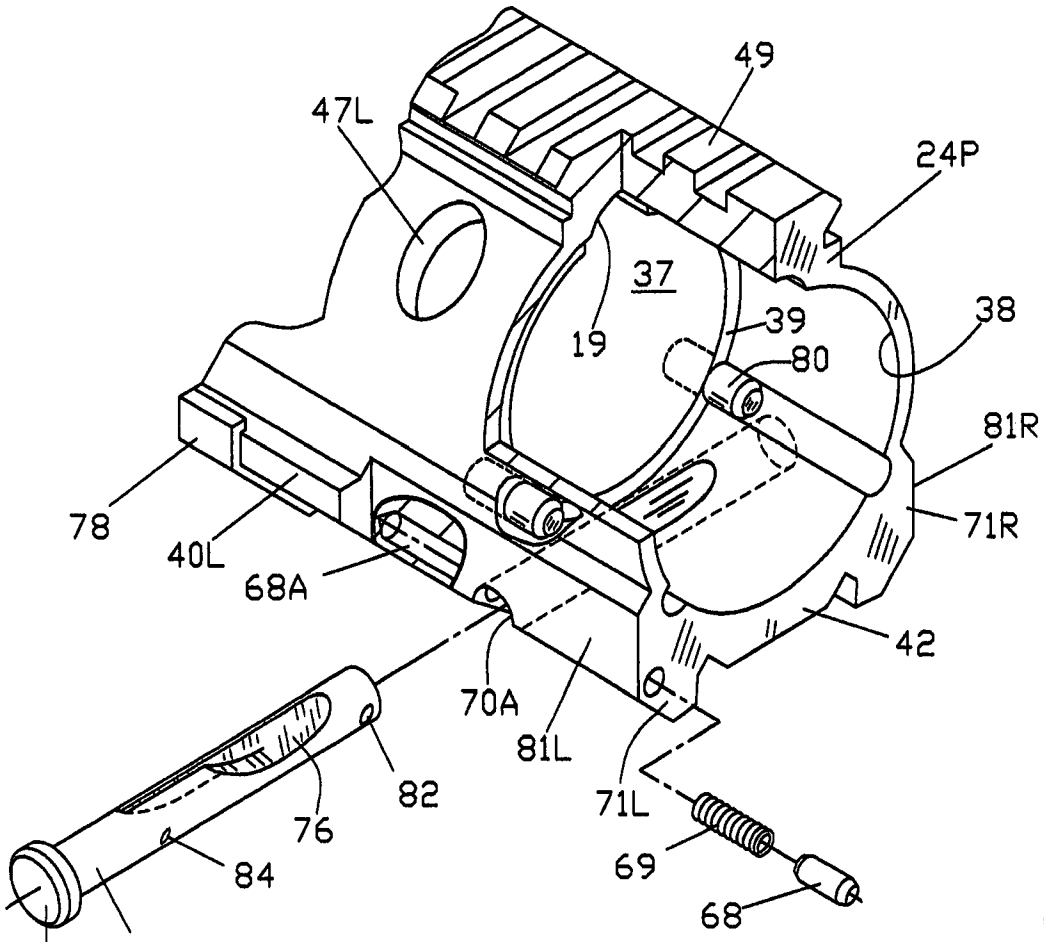
FIG. 10 is a partial perspective exploded view of an alternate embodiment handguard with latch pin, and alignment pins.

Referring now to FIGS. 3, 9 and 10, in a slightly different second embodiment of the present invention, barrel nut 50 is unchanged, but latch plate 35 and its recess 35R are deleted from the rear portion of handguard 24. Instead of a latch plate, an alternate embodiment handguard 24P is adapted with a transverse latch pin 70 which will secure handguard 24P, along with any attached accessories to barrel nut 50 using unique features now described.

This handguard system embodiment can be fitted to any conventional M16 style receiver, without requiring a slot in receiver forward lug 55. (This second embodiment will also function on receiver 23S having a slotted forward lug 55, the receiver style of the previous first embodiment).

Changes to handguard 24 occur at its rear portion, adjacent internal shoulder 39 with the middle and forward portions of handguard 24 unchanged.

Referring to FIGS. 9-9E and 10, a pair of alignment pins 80 are seen projecting longitudinally rearward from handguard shoulder 39, each pin 80 being aligned with the space between a pair of adjacent prongs 54, pins 80 adapted to slideably engage prongs 54 for limiting handguard 24P radial movement relative to nut 50.

As seen more clearly in FIG. 10, a pair of bases 71L and 71R are disposed at the lower rear portions of handguard 24P. The bases are integral to handguard 24P and each has an outward facing face 81L, 81R lying in a vertical plane and running longitudinally.

A handguard transverse through-hole 70A passes through both bases 71L, 71R. Hole 70A, seen best in FIGS. 9, 9A-9D and 10, is aligned longitudinally with prong rear faces 54R and is located slightly below barrel nut outer diameter 50D. Hole 70A is adapted to slideably receive a steel handguard latch pin 70. Pin 70 could have a diameter of about 0.25 inch and a length of about 2 inch, as an example.

Latch pin 70 is further defined as having a head 79 at one end and a relief cut 76 near the opposing end, cut 76 having a radius slightly larger than the radius of nut 50D diameter. Latch pin 70 further has a latch surface 75, lying in a vertical plane and running parallel with the length of the pin, transverse to handguard 24P. Several parts and features retain pin 70 within handguard 24P including a detent 68, a detent spring 69, a detent hole 68A, a detent slot 77, a disassembly hole 84 and a wire hole 82. Detent 68 and spring 69 are located in longitudinal hole 68A, located in base 81L, hole 68A intersecting pin hole 70A.

Detent 68 is a small cylindrical part which is urged by spring 69 and engages slot 77 located in the outer side surface of latch pin 70, thus limiting movement of pin 70 and retaining it within handguard 24P.

Disassembly hole 84 allows a small diameter tool, not shown, to enter hole 68A and depress detent 69, allowing pin 70 to be removed from hole 70A. Pin 70 has a transverse wire hole 82 to receive a redundant pin retaining means such as a wire or pin, not shown.

Considering the latched position of FIG. 9A, and referring still to FIGS. 9 and 10, latch surface 75 is adapted to engage the rear face 54R of at least one prong 54 when latch pin 70 is in the latched position of FIG. 9A, with head 79 abutting base face 81L, and handguard 24P is fully engaged with barrel nut 50 with handguard shoulder 39 abutting the prongs forward face 54F, and alignment pins 80 are engaged between pairs of prongs 54.

Considering the unlatched position shown in FIG. 9B, latch relief cut 76 is adapted to allow handguard 24P to be removed from barrel nut 50 when latch pin 70 is moved outward to the unlatched position, with head 79 away from base face 81L about one-half inch, allowing relief cut 76 to align with the array of prongs 54, permitting forward movement of handguard 24P off of barrel nut 50.

ALTERNATE EMBODIMENT

Extended Barrel Nut

Figure 11:
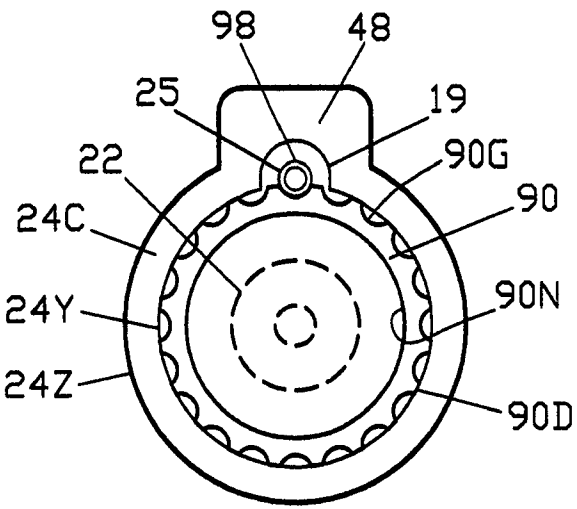
FIG. 11 is a front diagrammic view of an alternate embodiment extended barrel nut with longitudinal grooves engaged with a handguard of the present invention.

For an applications wherein a more rigid barrel nut might be desired for heavy handguard loads, this embodiment is provided. Referring to FIG. 11, shown is a diagrammic front view of an alternate embodiment barrel nut 90 and a mating handguard 24C encircling conventional firearm barrel 22. Firearm gas tube 25 is offset from barrel 22, and has an outwardmost portion 98. Portion 98 is defined as that upper part of gas tube 25 which is disposed adjacent to barrel nut 90 and lies furthest outward from barrel 22 centerline.

Extended barrel nut 90 is a single piece and has an elongated tubular shape and an inner surface 90N with a threaded portion adapted to threadably engage a firearm receiver, not shown, for securing barrel 22 to the receiver, and an outer surface with an outer diameter 90D. Outer diameter 90D is defined as disposed inward of gas tube outwardmost portion 98. Nut 90 outer surface is further defined as having a radial array of longitudinal grooves 90G, grooves 90G adapted to provide clearance to tube 25 inward portion. When nut 90 is tightened when securing barrel 22 until one of grooves 90G aligns with gas tube 25, barrel nut 90 outer surface which includes grooves 90G, passes between gas tube 25 and barrel 22.

Handguard 24C is a single piece and has a generally tubular shape having an outer surface 24Z. Outer surface 24Z includes a longitudinal rib 48. Handguard 24C also has an inner surface 24Y with an inner diameter which is slightly larger than barrel nut outer diameter 90D. Handguard inner surface 24Y is further defined as having a longitudinal groove 19, aligned with rib 48, for providing clearance to gas tube 25. Rib 48 is adapted to maintain the rigidity of handguard 24C adjacent groove 19.

The concept for this embodiment is that clearance for gas tube 25, instead of being provided entirely by handguard groove 19, is now shared between handguard groove 19 and nut groove 90G in the outer surface of nut 90. Barrel nut outer diameter 90D is defined as lying inward of an outwardmost portion 98 of firearm gas tube 25. This continues the concept and intention of the present invention of keeping the barrel nut and handguard diameters to a minimum whenever possible.

The concept of nut 90 having a larger outside diameter 90D, compared to diameter 50D of the first barrel nut 50 embodiment shown in diagrammic view 2C, while nut 90 retains the same inner surface configuration, adds stiffness to nut 90.

Operation

First Embodiment

Referring to FIGS. 1, 3, 6, and 6E, an M16 style firearm can be modified to accept this new and improved handguard system by using one of the methods that follow. With all methods, beginning with an unloaded firearm, the process is simplified if the upper receiver is removed from the lower receiver by retracting the forward and rear transverse pins.

Any operating devices within upper receiver 23 should be removed. Next, the existing handguard system, gas block, gas tube, and barrel nut are removed from the firearm. The first embodiment of the present invention is integrated to the firearm in one sense in that it utilizes the firearm forward transverse pin 31 to secure handguard 24 to the firearm.

This requires a slot in receiver 23 forward lug which will receive the handguard latch plate and allow firearm forward transverse pin to engage the lug transverse hole and latch plate hole, thereby securing the handguard to the firearm.

With slot 33 added, receiver 23 is designated receiver 23S. Forming the slot 33 in the receiver lug 55 is a precise but commonplace task for a gunsmith, armorer or machine shop. For mass production, the slot would be a planned operation added to the many other machining operations involved in producing a receiver. Referring to FIG. 6E, slot 33, a nominal 0.08 to 0.12 wide, should be a snug sliding fit on latchplate 35.

Next, with barrel 22 inserted into the forward end of receiver 23, extended barrel nut 50 is installed over muzzle end 20 of barrel 22 and slid along until nut threads 58 engage receiver threaded barrel port 64. When nut 50 is tightened with prongs 54 aligned to permit installation of gas tube 25 into receiver gas tube port 26, nut annular shoulder 59 urges barrel flange 62 against barrel port face 63.

To accomplish maximum benefit from the present invention, installation of a conventional gas block 28 of the low profile style is recommended at this point in the process. If the original gas block was the low profile style, it could be reused. Gas block 28 is secured to gas tube 25 and barrel 22 with conventional hardware such as roll pins and set screws. Depending on the specific firearm and gas tube 25, minor reforming of gas tube 25 may be needed in order to clear the forward end of extended barrel nut 50. This is readily accomplished by a gunsmith with a hand tool such as a tubing bender.

Referring to FIGS. 3 and 6, the firearm is now ready to receive handguard 24 with attached latchplate 35. With handguard rear end 15 just forward of barrel muzzle 20, handguard groove 19 is aligned with gas tube 25, and handguard 24 is moved rearward, sliding over barrel 22, gas block 28, gas tube 25 and barrel nut 50, handguard inner diameter 37 engaging barrel nut outer diameter 50D, latch plate 35 engaging lug slot 33, plate hole and lug hole aligning to permit engagement of firearm transverse pin 31.

Adjustment screw 72, if not already adjusted, can be adjusted to provide a firm sliding fit between handguard 24 and extended barrel nut 50.

The embodiment just described, compared to prior art, provides has a substantially reduced handguard outer diameter with the advantages of reduced size and weight, and the ability to mount accessories closer to the barrel, thereby improving firearm handling quality.

In addition, this embodiment provides a handguard system with accessory interface capability including integral military standard rails and threaded helicoil insert patterns while at the same time being a floating handguard, attaching to the firearm only at the rearward portion of handguard 24, not touching the barrel 22 forward portion Furthermore, this embodiment provides that a handguard 24 with its complement of accessories which may include removable rail 44 and handgrip 78, can be quickly installed or exchanged by simply retracting or disengaging firearm pin 31 and sliding handguard 24 forward and off barrel 22 and quickly replacing it with another handguard 24 with the same or different accessories, re-engaging firearm pin 31.

Referring now to FIG. 1A, if a large gas block style such as an integral front sight style 65 is to be fitted during the above described firearm modification process, instead of recommended low profile block 28, handguard 24 must be installed over barrel 22, gas tube 25, and barrel nut 50, engaging barrel nut 50, before a large style integral sight gas block 65 is installed to barrel 22, and gas tube 25. Similarly large style gas block 65 must be removed prior to or simultaneously with the removal of handguard 24.

For this firearm configuration, the firearm having a large style gas block 65, the advantages of the present invention, described above, are all retained with the exception of quick installation/removal of handguard 24.

Operation

Second Embodiment

Referring to FIGS. 9-9E and 10, in a slightly different handguard system embodiment, modification and installation to an M16 style firearm is simplified. Furthermore, this embodiment will install to any conventional M16 style receiver and no slot in receiver forward lug 55 is required.

Barrel nut 50 configuration is unchanged. Handguard 24P, the front and middle portions being identical to the first embodiment, instead of having a latch plate 35 which engages a firearm forward transverse pin 31, has its own detent-retained and rearward located transverse latch pin 70, which in the inward latched position, engages the barrel nut prongs rear face 54R, while handguard shoulder 39 abuts prongs forward face 54F, to secure handguard 24P longitudinally.

A pair of pins 80, each engage a space between adjacent prongs 54 to limit radial movement of handguard 24P. When latch pin 70 is pushed outward about 0.5 inch, to the unlatched position, relief cut 76 in pin 70 allows handguard 24P to move forward and off barrel 22.

Operation

Construction

Large scale production of the handguard system of the present invention can be accomplished using conventional firearm manufacturing materials, processes and machinery.

For example, barrel nut 50 could be produced of steel or aluminum from round bars or tubing. Handguard 24 could be produced from aluminum as a casting, forging or extrusion and machined to final configuration. In a slightly different embodiment, handguard 24 could be manufactured by forming thin wall metal tubing to obtain a tube-rib-groove shape and overmolding a polymer outer portion. In small or experimental quantities, handguard 24 could be cast and machined or fabricated by welding together partially machined high strength aluminum tube and bar stock and then machining the welded assembly to final configuration.

Fixturing the parts to hold them in alignment during the welding and machining operations is a technique known to gunsmiths, machinists and others skilled in the art of producing precision metal parts and assemblies.

Information on modifying M16 style firearms can be found in the book "The Complete Guide To AR-15 Accuracy", Martin and Tillman, published 2000, pages 126-130.

M16 parts, including barrels, receivers, gas blocks and gas tubes can be provided by a number of suppliers including Brownell's, 200 South Front St., Montezuma, Iowa (wide variety of parts, barrels, gas blocks); Armalite, Inc. P.O Box 299, Geneseo, Ill. (parts, gas blocks, floating handguard gas tubes such as part EU0172); Falcon Industries, P.O. Box 1690, Edgewood, N. Mex. (standard and custom molded rail covers and handgrips).

CONCLUSIONS, RAMIFICATIONS AND SCOPE

Accordingly, the reader will see that, according to the invention, I have provided a floating handguard system which by the novel design of its parts results in a firearm and handguard system with improved characteristics which include size, weight and accuracy.

In addition, the present invention enables a user to quickly interface or exchange a complement of handguard mounted accessories, because the handguard is latched to the firearm with a transverse pin.

Size and weight improvements are accomplished by accommodating (providing clearance for) a longitudinal operating member or gas tube within a unique handguard tube design which could be termed tube-rib-groove construction.

This tubular handguard construction allows a small diameter barrel nut outer surface, unlike prior art floating handguard systems which have a larger diameter barrel nut outer surface because they accommodate the operating member or gas tube between the inner and outer barrel nut surfaces by using an array of longitudinal passages located between the inner and outer nut surfaces.

Prior art handguard tube outside diameters of the style just described are generally about 20 percent greater in diameter and weight than accomplished by the present invention and this means that handguard mounted accessories are 20 percent farther from the weapon centerline for prior art handguards.

Firearm overall size affects its handling quality. Since size or external handguard tube volume is a function of the square of the diameter, prior art handguard tube size or volume is on the order of 40 percent greater when compared with the present invention. Thus, the present invention also provides improved handling characteristics when compared to prior floating handguard systems.

While the above description contains many specific details, these should not be considered as limitations, but rather as examples of presently preferred embodiments.

Accordingly, the scope of the invention should be limited not by the embodiments, but by the appended claims and their legal equivalents.

I claim:

1. A handguard system for use on a firearm, the firearm having a receiver, a barrel, a gas block, and a gas tube, the receiver having a forward portion, a top, and a rearward portion, the gas block attached to the barrel, the barrel attached to the receiver, the gas tube connecting the gas block to the receiver, the gas tube further defined as being disposed offset from the barrel, the handguard system comprising:

an extended barrel nut being a single-piece and having a tubular shape, the extended barrel nut having an outer surface, an inner surface, a forward and a rear end, the outer surface disposed to pass between the gas tube and the barrel, the inner surface including a rearward disposed thread adapted to threadably engage the receiver to secure the barrel to the receiver; and a handguard being a single-piece having a generally tubular shape, the handguard having a forward end, a rear end, a top, a bottom, a left and a right side, an outer and an inner surface, the outer surface having a longitudinal top rib; and the inner surface having a first inner diameter, the first inner diameter being slightly larger than the extended barrel nut outer surface; and the inner surface further defined by having a groove, the groove aligned with rib, the groove adapted to provide clearance to the gas block and gas tube, the handguard adapted to slide over and along the barrel, gas block, gas tube, and extended barrel nut, the handguard first inner diameter engaging the outer surface of the extended barrel nut;

wherein, the handguard surrounds the barrel and attaches to the firearm only at the handguard rear end.

2. A handguard system as recited in claim 1 further comprising:

an annular shoulder portion on the extended barrel nut inner surface, the shoulder portion disposed forward of and adjacent to the threaded portion, the annular shoulder defining an inner diameter smaller than diameter of the threads for securing the barrel to the receiver.

3. A handguard system as recited in claim 2 further comprising:

a plurality of prongs radially protruding from the extended barrel nut outer surface, the prongs having a forward face, a rear face, and a uniform space between adjacent prongs, the prongs further defined as disposed rearward a predetermined distance from said forward end of said extended barrel nut for permitting said handguard inner diameter to engage said extended barrel nut outer diameter, the prong outer ends defining a prongs diameter; and a second inner diameter in the handguard inner surface, the second diameter beginning at the handguard rear end and proceeding forward a predetermined distance, the second inner diameter concentric with and larger than the first inner diameter and the prongs diameter; and the first and second inner diameters separated by a handguard shoulder, the second inner diameter providing clearance to the prongs when the handguard first inner diameter is engaged with the barrel nut outer diameter.

4. A handguard system as recited in claim 3 further comprising:

a bottom rib formed on the handguard outer surface opposite the top rib.

5. A handguard system as recited in claim 4 wherein:

the top and bottom ribs are further defined as beginning at the handguard rear end and proceeding forward, each a separate predetermined distance, the ribs further defined as having a generally rectangular cross section and an outward flat surface, the flat surface having at least about the width of a standard military rail, the rail being about 0.83 inch wide; and each rib projects its own predetermined constant dimension from the handguard outer surface.

6. A handguard system as recited in claim 5 wherein:

the top rib projects from the handguard outer surface by varying predetermined dimensions at predetermined longitudinal locations.

7. A handguard system as recited in claim 6 wherein:

longitudinal portions of one or more ribs are formed into a military standard rail, the rail having a standard male dovetail cross section about 0.83 inch wide and a plurality of transverse slots on the rail outward face, the military rail shape adapted to interfacing accessories having female dovetail shape clamping means.

8. A handguard system as recited in claim 7 further comprising:

a plurality of threaded helicoil inserts and a plurality of vent through-holes distributed longitudinally along the bottom rib outer face, the inserts adapted to receive a screw; and an adjustment screw threaded into one of the helicoil inserts, the adjustment screw disposed to bear upon the barrel nut outer surface, for influencing the handguard engagement with the barrel nut, the engagement between the handguard and the barrel nut adjustable between a tight sliding fit and a fixed, immovable fit.

9. A handguard system as recited in claim 8 further comprising:

a plurality of longitudinally distributed vent through-holes and helicoil inserts in the handguard upper left and upper right portions; and a plurality of threaded helicoil inserts in the handguard forward left and right sides, the inserts permitting the mounting of an accessory device to the handguard by means of one or more screws.

10. A handguard system as recited in claim 9 further comprising:

a plurality of vent through-holes in the barrel nut outer surface, disposed forward of the prongs, the vent holes further defined as aligned longitudinally with the handguard upper and bottom vent holes; and the barrel nut vent holes diameter, quantity, and location adapted to ensure a ventilation path from the barrel through the barrel nut and through the handguard, for the release of barrel heat.

11. A handguard system as recited in claim 10 further comprising:

a conventional removable military standard rail accessory attached to forward left side of the handguard, the removable rail attached with at least one screw engaging the helicoil insert, the removable rail allowing the interfacing of ancillary equipment.

12. A handguard system as recited in claim 11 further comprising:

a latch plate, being a flat elongated member, the forward portion adapted to attach to the handguard lower rear portion by a screw, the plate lying in a vertical plane and adapted to project outward from the rear of the handguard; and the plate having a plate transverse hole at its rear end, the plate transverse hole adapted to receive a firearm transverse pin.

13. A handguard system as recited in claim 12 further comprising:

an integral forward lug on the firearm receiver, the lug having a transverse hole and a slot, the slot further defined as lying in a vertical plane, running longitudinally, and bisecting the forward lug; and the handguard system a recess on the lower rear portion of the handguard, the recess aligned with the slot in the firearm receiver forward lug and adapted to receive a portion of the latch plate, the recess further having a threaded hole for receipt of a screw for fixing the plate to the handguard;

wherein, the handguard inner surface is adapted to slide over the barrel, gas block, gas tube, and barrel nut, the handguard first inner diameter engaging the barrel nut outer diameter, the latch plate engaging the receiver lug slot, the latch plate transverse hole aligned with the lug transverse hole, the aligned holes permitting passage of a firearm transverse pin therethrough, thereby securing the handguard to the firearm.

14. A handguard system as recited in claim 11 further comprising:

an alignment pin projecting longitudinally rearward from the handguard shoulder, the pin aligned with the space between a pair of adjacent prongs, the pin adapted to slideably engage the prongs for limiting handguard radial movement.

15. A handguard system as recited in claim 14 further comprising:

a pair of bases disposed at the lower left and right portions of the handguard, the bases being integral to the handguard and each having an outward facing face lying in a vertical plane and running longitudinally; and a handguard transverse through-hole passing through both bases, the hole being aligned longitudinally with the barrel nut rear prong faces and slightly below the barrel nut outer diameter, the hole adapted to receive a handguard latch pin; and a handguard latch pin adapted to slideably engage the hole, the pin further defined as having a head at one end and a relief cut near the opposing end, the latch pin further having latch surface, the latch surface lying in a vertical plane and running parallel with the length of the pin; and the latch surface adapted to engage the rear face of at least one prong when the latch pin is in the latched position with the head abutting a base face, the handguard fully engaged with the barrel nut, the beforesaid handguard shoulder abutting the prongs forward face, and the beforesaid alignment pin engaged with the prongs; and the latch relief cut is adapted to allow the handguard to be removed from the barrel nut and the firearm, when the latch pin head is moved outward to the unlatched position, away from the base about one-half inch, allowing the relief cut to align with the prongs, permitting forward movement of the handguard off the barrel nut and firearm.

16. A handguard system as recited in claim 1 wherein:

the barrel nut has a ratio of its overall length to its outer diameter in the range of about 1.2:1 to about 4:1.

17. A handguard system for use on a firearm, the firearm having a receiver, a barrel, and a gas tube, the receiver having a forward portion, a top, and a rearward portion, the barrel and gas tube attached to said receiver, the gas tube further defined as being disposed offset from the barrel, the handguard system comprising:

an extended barrel nut being a single-piece and having a tubular shape, said extended barrel nut having an outer surface with an outer diameter, said outer surface being an unthreaded surface, an inner surface, a forward end and a rear end, said outer surface disposed to pass between said gas tube and said barrel; and said inner surface including a reduced diameter portion and an adjacent rearward disposed threaded portion adapted to threadably engage the receiver to secure said barrel to said receiver; and a handguard being a single-piece having a generally tubular shape, said handguard having a forward end, a rear end, a top, a bottom, a left and a right side, an outer and an inner surface; and said inner surface having an inner diameter, said inner surface being an unthreaded surface, said inner diameter being slightly larger than said extended barrel nut said outer surface; and said handguard inner surface further defined by having a groove, said groove adapted to provide clearance to said gas tube, said handguard adapted to slide over and along said barrel, gas tube, and extended barrel nut, said handguard inner diameter engaging said outer surface of said extended barrel nut;

wherein, said handguard surrounds the barrel and attaches to the firearm only at the handguard rear end.

18. The handguard system of claim 17 wherein:

said gas tube of said firearm has a gas tube outwardmost portion and said outer surface of said extended barrel nut is disposed inward of said gas tube outwardmost portion; and said inner diameter of said handguard is disposed inward of said gas tube outwardmost portion.

19. The handguard system of claim 18 further including:

said handguard outer surface having a longitudinal rib, said rib aligned with handguard said groove.

20. The handguard system of claim 18 further including:

said extended barrel nut outer surface further defined as having a radial array of longitudinal grooves, said longitudinal grooves formed into said outer surface, said grooves adapted to provide clearance to said gas tube, a groove when aligned with said gas tube, permitting said extended barrel nut outer surface to pass between said gas tube and said barrel; wherein said extended barrel nut outer surface engages said inner surface of said handguard.

21. The handguard system of claim 19 wherein:

said receiver of said firearm is an M4 upper receiver.

* * * * *